US005307147A

United States Patent [19]

Kumasaka et al.

[11] Patent Number: 5,307,147

[45] Date of Patent: Apr. 26, 1994

[54] ELECTROPHOTOGRAPHIC RECORDING APPARATUS HAVING A PLURALITY OF DEVELOPING DEVICES WHICH CAN BE CHANGED OVER

[75] Inventors: Takao Kumasaka; Yuzuru Simazaki; Kunio Satoh, all of Hitachi; Tomio Sugaya, Katsuta; Youji Hirose, Mito, all of Japan

[73] Assignees: Hitachi, Ltd.; Hitachi Koki Co., Ltd., both of Tokyo, Japan

[21] Appl. No.: 945,190

[22] Filed: Sep. 15, 1992

[30] Foreign Application Priority Data

Sep. 18, 1991 [JP] Japan ..... 3-265423

[51] Int. Cl.[5] ..... G03G 15/01

[52] U.S. Cl. ..... 355/326 R; 355/260

[58] Field of Search ..... 355/326, 327, 245, 260, 355/200, 210; 346/160

[56] References Cited

U.S. PATENT DOCUMENTS

| | | | |
|---|---|---|---|
| 4,697,915 | 10/1987 | Hayashi et al. | 355/327 |
| 4,937,626 | 6/1990 | Kohtani et al. | 355/245 |
| 5,053,820 | 10/1991 | Preszler et al. | 355/245 |
| 5,111,245 | 5/1992 | Dececca et al. | 355/245 |
| 5,172,165 | 12/1992 | Hatakeyama et al. | 355/245 X |
| 5,177,507 | 1/1993 | Ng | 355/326 X |

FOREIGN PATENT DOCUMENTS

| | | | |
|---|---|---|---|
| 0037052 | 3/1977 | Japan | 355/326 |
| 60-257459 | 12/1985 | Japan . | |
| 62-102261 | 5/1987 | Japan . | |
| 2-27375 | 1/1990 | Japan . | |
| 2-61665 | 3/1990 | Japan . | |
| 2-64569 | 3/1990 | Japan . | |
| 2-83557 | 3/1990 | Japan . | |
| 2-100065 | 4/1990 | Japan . | |
| 2-167575 | 6/1990 | Japan . | |
| 3-21962 | 1/1991 | Japan . | |

*Primary Examiner*—A. T. Grimley
*Assistant Examiner*—Sandra L. Brasé
*Attorney, Agent, or Firm*—Kenyon & Kenyon

[57] ABSTRACT

An electrophotographic recording apparatus is provided having a reduced overall size. The space around a photosensitive member required for the developing unit to be located is minimized, more particularly, it i minimized in the lengthwise directional space. In the electrophotographic recording apparatus having a photosensitive member which moves at a predetermined speed; an exposure device for exposing the photosensitive member; a developing unit for developing an electrostatic latent image obtained by the exposure; and a transferring device for transferring a developed visible image to a recording paper sheet or the like, the developing unit is composed of developing devices, a plurality of supporting members for supporting the developing devices and an element for rotating the supporting members. The supporting members can be rotated while making a portion adjacent to a widthwise directional end of the photosensitive member to be a supporting point in a range from a state where the surface of the photosensitive member and the surface of a developing roll of each developing device run parallel to each other to a state where they are positioned substantially perpendicular to each other.

27 Claims, 5 Drawing Sheets

ELECTROPHOTOGRAPHIC RECORDING APPARATUS HAVING A PLURALITY OF DEVELOPING DEVICES WHICH CAN BE CHANGED OVER

BACKGROUND OF THE INVENTION

The present invention relates to an electrophotographic recording apparatus capable of performing color printing, and, more particularly, to an electrophotographic recording apparatus having a plurality of developing devices so disposed adjacent to a photosensitive member as to be selectively moved to a position at which development can be performed at the time of the photographic recording operation.

Hitherto, electrophotographic recording apparatuses of a type having a developing unit which includes a plurality of developing devices have been disclosed in Japanese Patent Unexamined Publication Nos. 2-61665 and 2-27375 each having a developing unit incorporating a plurality of developing devices disposed in a vertical direction so that a desired developing device is moved at the time of use to a position at which development can be performed by vertically moving the developing unit. Another type has been disclosed in Japanese Patent Unexamined Publication No. 2-64569 which has a developing unit having a plurality of developing devices disposed in the vertical direction so that the developing unit is vertically moved at the time of use so as to select a desired developing device, the selected developing device being further pushed forward in the horizontal direction to the position at which development can be performed (hereinafter called a "vertical reciprocative type"). Another type has been disclosed in Japanese Patent Unexamined Publication No. 2-83557 which includes a developing unit having a plurality of developing devices disposed in the horizontal direction so that a desired developing device is moved to the position at which development can be performed by moving the aforesaid developing unit (hereinafter called a "horizontal reciprocative type"). Other types have been further disclosed in Japanese Patent Unexamined Publication Nos. 2-83557, 2-100065, 62-102261 and 60-257459, and the like each having a developing unit including a plurality of developing devices disposed in the circumferential direction thereof so that a desired developing device is moved to a position at which development can be performed by rotating the developing unit around the central axis thereof at the time of use (hereinafter called a "rotative type"). Furthermore, other types have been disclosed in Japanese Patent Unexamined Publication Nos. 3-21962 and 2-167575 each having a developing unit which includes a plurality of developing devices disposed in a sector configuration so that the developing unit is rotated to form a circular arc at the time of use, causing a desired developing device to be moved to the position at which development can be performed (hereinafter called an "arc reciprocative type").

Although the aforesaid conventional electrophotographic recording apparatuses each having a developing unit, which includes a plurality of the developing devices, are able to considerably shorten the length required to dispose the developing unit adjacent to the photosensitive member, the realized effect of shortening the length has been unsatisfactory. In particular, the aforesaid vertical reciprocative type apparatus encounters a problem in that an excessively large portion is required to dispose the developing unit in a vertical region adjacent to the photosensitive member including a passage through which the developing unit is moved. The horizontal reciprocative type apparatus similarly raises a problem in that an excessively large portion is required to dispose the developing unit in a horizontal region adjacent to the photosensitive member including a passage through which the developing unit is moved. The rotative type apparatus also raises a problem in that an excessively large portion is required to dispose the developing unit in a region adjacent to the photosensitive member including its rotation drive mechanism. Furthermore, the arc reciprocative type apparatus raises a problem in that an excessively large portion is required to dispose the developing unit in a region adjacent to the photosensitive member including its rotation drive mechanism.

SUMMARY OF THE INVENTION

Accordingly, an object of the present invention is to provide an electrophotographic recording apparatus capable of overcoming the aforesaid problems and reducing the overall size of the apparatus including the developing unit by minimizing the space around the photosensitive member required for the developing unit to be located, and more particularly, by minimizing the aforesaid space in the direction in which the photosensitive member is moved.

In order to achieve the aforesaid object, an electrophotographic recording apparatus according to the present invention comprises: a photosensitive member which moves at a predetermined speed; an exposure device for exposing the photosensitive member; a developing unit for developing an electrostatic latent image obtained by the exposure; and a transferring device for transferring a developed visible image to a recording paper sheet or the like, wherein the developing unit is composed of developing devices, a plurality of supporting members for supporting the developing devices and means for rotating the supporting members; and the supporting members can be rotated while making a portion adjacent to a widthwise directional end of the photosensitive member to be a supporting point in a range from a state where the surface of the photosensitive member and the surface of a developing roll of each developing device run parallel to each other to a state where they are positioned substantially perpendicular to each other.

When a first developing device is desired to be used, a supporting member, to which the desired first developing device is fastened, is rotated and moved so as to make the surface of the developing roll of the first developing device to run parallel to the surface of the photosensitive member. As a result, the electrostatic latent image formed on the surface of the photosensitive member can be developed by the first developing device.

When a second developing device is used in place of the first developing device, the supporting member, to which the first developing device is fastened, is rotated so as to make the surface of its developing roll to be substantially perpendicular to the surface of the photosensitive member. Then a supporting member, to which the second developing device is fastened, is rotated so as to make the surface of the developing roll of the second developing device to run parallel to the surface of the photosensitive member. As a result, the electrostatic latent image formed on the surface of the photosensitive member can be developed by the second developing device.

In a case where a third developing device and a fourth developing device are desired to be used as an alternative to the first and the second developing devices, the third and the fourth developing devices are disposed at positions which are different from the positions at which the first and the second developing devices are positioned. For example, the first and the second developing devices are disposed at the same positions (the opposite positions at the widthwise directional ends of the photosensitive member) with respect to the lengthwise direction of the photosensitive member, while the third and the fourth developing devices are disposed at the different positions with respect to the lengthwise direction of the photosensitive member. As a result, the third and the fourth developing devices can be selectively used simultaneously with the first and the second developing devices regardless of the state of use of the first and the second developing devices.

In this case, each of the developing devices is simply rotated together with its supporting member while making a widthwise directional end or the two widthwise directional ends of the photosensitive member to be the supporting point and while maintaining the position in the lengthwise direction of the photosensitive member. Therefore, the space around the photosensitive member required for the developing unit to be located, and, more particularly, the space of the same in the direction, in which the photosensitive member is moved, can be minimized.

DETAILED DESCRIPTION

Preferred embodiments of the present invention will now be described with reference to the drawings.

Figure 1:
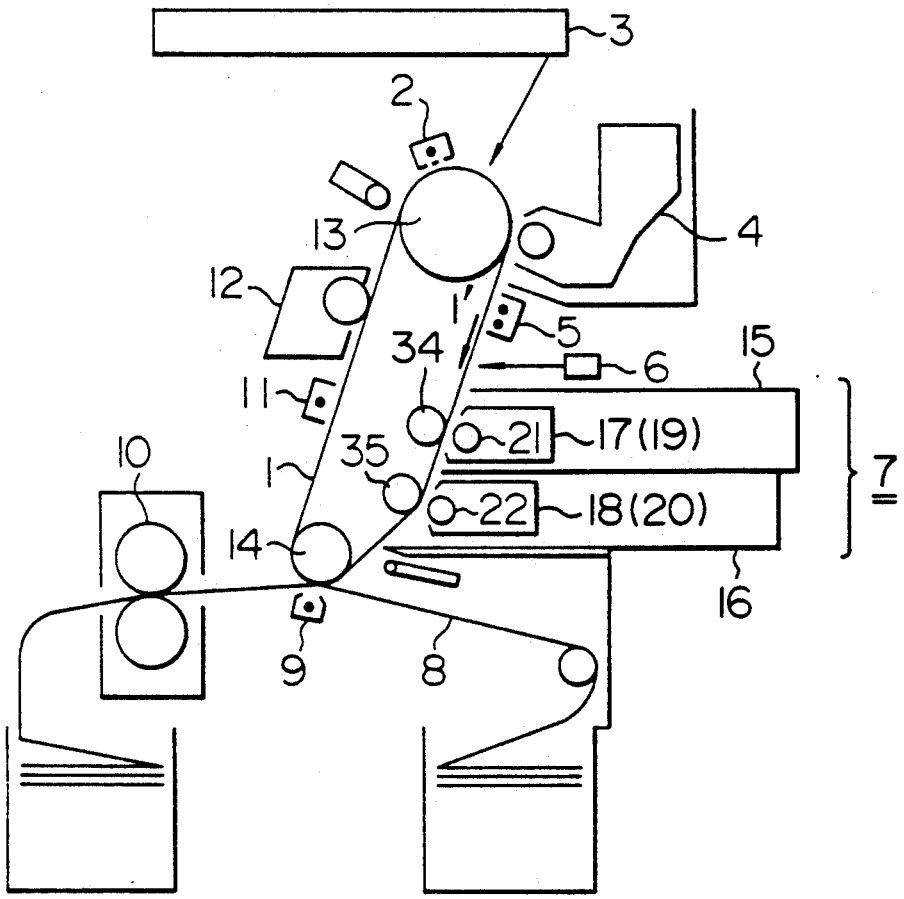
FIG. 1 is a structural view which illustrates a first embodiment of an electrophotographic recording apparatus according to the present invention.

FIG. 1 is a structural view which illustrates a first embodiment of an electrophotographic recording apparatus according to the present invention.

Referring to FIG. 1, reference numeral 1 denotes a belt-like photosensitive member, 2 denotes a first charger, 3 denotes a first exposure means including a laser optical system, 4 denotes a first developing device, 5 denotes a second charger, 6 denotes a second exposure means including a laser optical system, 7 denotes a multicolor developing unit, 8 denotes a recording paper sheet, 9 denotes a transferring device, 10 denotes a fixer, 11 denotes a charge adjuster, 12 denotes an electrostatic bias cleaner, 13 and 14 respectively denote first and second drive rollers, 15 denotes a first color changing unit, 16 denotes a second color changing unit, 17, 18, 19 and 20 denote developing devices, 21 and 22 denote developing rollers, and 34 and 35 denote opposed rollers.

The first developing device 4 is filled with black toner so that a black visible image is formed on the surface of the photosensitive member 1. Furthermore, the first color changing unit 15 of the multicolor developing unit 7 is provided with the two developing devices 17 and 19, while the second color changing unit 16 is provided with the two developing devices 18 and 20, the developing devices 17 and 19 and the developing devices 18 and 20 being so arranged that they can be selectively used. Furthermore, the developing devices 17, 18, 19 and 20 are respectively filled with toner of desired colors so that visible images of various colors are selectively formed in the multicolor developing unit 7.

The operation of the electrophotographic recording apparatus according to this embodiment is performed as follows.

The belt-like photosensitive member 1 is moving in a direction designated by an arrow 1' shown in FIG. 1 at a predetermined speed due to the drive effected by the first and the second drive rollers 13 and 14. At this time, the surface of the belt-like photosensitive member 1 is first uniformly charged by the first charger 2. Then, an electrostatic latent image is formed on the aforesaid surface due to exposure effected by the first exposure means 3. Then, the electrostatic latent image is developed by the first developing device 4, so that a first visible image corresponding to the electrostatic latent image is formed on the aforesaid surface. Then, the surface of the belt-like photosensitive member 1 is again uniformly charged by the second charger 5, and then another electrostatic latent image is formed on the aforesaid surface due to exposure effected by the second exposure means 6. The other electrostatic latent image is developed with the toner of a desired color in any one of the developing devices 17, 18, 19 and 20 selected by the multicolor developing unit 7. As a result, a second visible image of the desired color corresponding to the other electrostatic latent image is so formed on the aforesaid surface as to be superposed on the first visible image. It is preferable that the developing devices 17, 18, 19 and 20 of the multicolor developing unit 7 be non-contact developing type devices in order to prevent a problem that the first visible image is scraped off during the developing process.

The first and the second visible images thus formed on the surface are transferred to the recording paper sheet 8 which has been conveyed to a position at which the transferring device 9 is so disposed as to face the recording paper sheet 8. The transferred visible image is, together with the recording paper sheet 8, conveyed to the fixer 10 so that the visible image is fixed on the surface of the recording paper sheet 8. The opposed rollers 34 and 35 are provided for the purpose of maintaining the intervals between the surface of the belt-like photosensitive member 1 and the developing rollers 21 and 22 of each of the developing devices 17 to 20 disposed in the multicolor developing unit 7 at a predetermined distance.

The toner left on the surface of the belt-like photosensitive member 1 after the transference process has been completed is subjected to an adjustment process in which its charge level is made to be a predetermined level by the charge adjuster 11. Then, the toner is removed from the aforesaid surface by the electrostatic bias cleaner 12, and the aforesaid processes are again performed.

As the belt-like photosensitive member 1, a member is used which is manufactured by superposing a CGL (Charge Carrier Generation Layer) or a CTL (Charge Carrier Transport Layer) on a conductive belt-like supporting member made of metal or a conductive resin, or the like. As an alternative to this, a member is used which is manufactured by forming a conductive layer on a belt-like supporting member made of an insulating resin and then superposing a CGL (Charge Carrier Generation Layer) or a CTL (Charge Carrier Transport Layer) on the conductive layer.

Although a belt having a seam may be used as the belt-like photosensitive member 1, it is preferable that a seamless belt be used. The reason for this lies in that, the use of the belt-like photosensitive member 1 having a seam causes a necessity of using a control means for preventing a problem which will take place in that an electrostatic image or a visible image is formed in the seam portion in accordance with the result of a detection of the seam made by any means while the use of the seamless belt-like photosensitive member 1 enables the use of the aforesaid control means to be omitted from the structure.

Then, the selection of the developing devices to be performed in the first and the second color changing units 15 and 16 will now be described.

Figure 2:
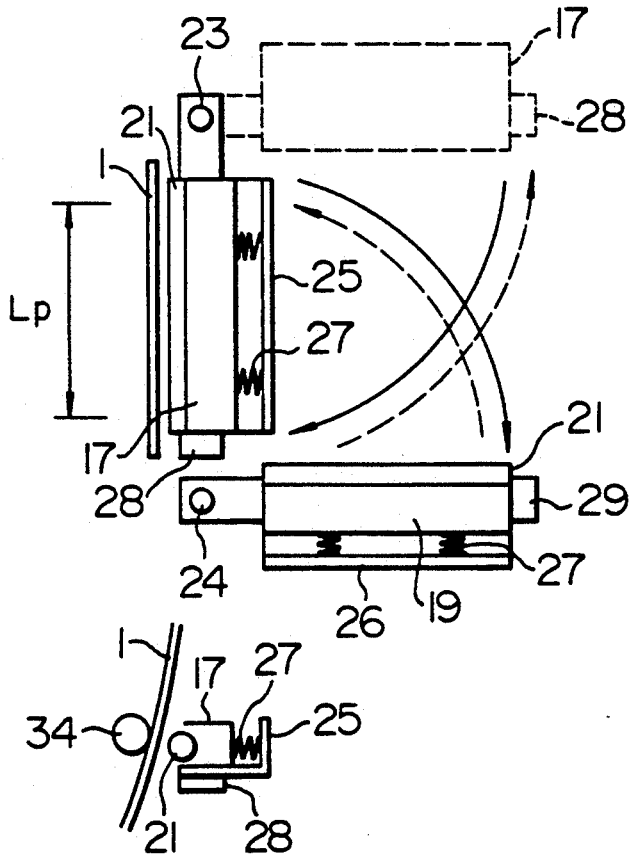
FIG. 2 is a schematic structural view which illustrates the configuration of developing devices of a color changing unit and a state of movement of the developing devices.

FIG. 2 is a schematic structural view which illustrates the configuration of the developing devices of the first color changing unit 15 and a state of movement of the developing devices.

Referring to FIG. 2, reference numerals 23 and 24 denote rotational shafts, 25 and 26 denote developing-device supporting members, 27 denotes a pressing spring, and 28 and 29 denote supporting-member rotation members. The other elements, which are the same as those shown in FIG. 1, are given the same reference numerals.

The developing-device supporting members 25 and 26 are fastened to the rotational shafts 23 and 24 via the supporting-member rotation members 28 and 29, each of the developing-device supporting members 25 and 26 being so structured that it can be rotated into the direction, in which the belt-like photosensitive member 1 is moved, while maintaining the position of each of the developing-device supporting members 25 and 26. In this case, the developing device 17 is fastened to the developing-device supporting member 25 and the developing device 19 is fastened to the developing-device supporting member 26. The rotational shafts 23 and 24 are so respectively disposed at the opposite two end portions in the widthwise direction of the belt-like photosensitive member 1 that the developing devices 17 and 19 do not interfere with each other at the time of the rotation of either of the selected developing device 17 or 19 to a predetermined position for use adjacent to the belt-like photosensitive member 1.

The first color changing unit 15 is operated as follows:

FIG. 2 shows a state where the developing device 17 is used and the developing device 19 is not used. In this state, the developing-device supporting member 25, to which the developing device 17 is fastened, is rotated toward the belt-like photosensitive member 1 by the supporting-member rotation member 28 rotatively held by the rotational shaft 23, causing its developing roller 21 to run parallel to the surface of the belt-like photosensitive member 1. On the other hand, the developing-device supporting member 26, to which the developing device 19 is fastened, is rotated in a direction in which it is moved away from the belt-like photosensitive member 1 by the supporting-member rotation member 29 rotative held by the rotational shaft 24, causing its developing roller 21 to be disposed substantially perpendicular to the surface of the belt-like photosensitive member 1.

If also the developing device 17 is desired not to be used, the developing-device supporting member 25 is rotated by the supporting-member rotation member 28 in a direction in which the developing-device supporting member 25 is moved away from the belt-like photosensitive member 1. As a result, the developing-member supporting member 25 and the supporting-member rotation member 28 are brought into states designated by dashed lines shown in FIG. 2, causing the developing device 17 to be brought into the non-used state similarly to the developing device 19.

If the developing device 19 is desired to be in the used state on the contrary, the developing-device supporting member 26 is rotated toward the belt-like photosensitive member 1 by the supporting-member rotation member 29. As a result, its developing roller 21 is made to run parallel to the surface of the belt-like photosensitive member 1, causing development by means of the developing device 19 to be enabled.

In this case, the drive for rotating each of the developing-device supporting members 25 and 26 is performed by a sequence control effected by a microcomputer included in the electrophotographic recording apparatus.

As shown in FIG. 2, pushing springs 27 are disposed between the developing-device supporting members 25, 26 and the developing devices 17, 19 fastened to the developing- device supporting members 25 and 26. Each of the pushing springs 27 has a function of, in cooperation with the developing-device supporting members 25 or 26, pressing stoppers (omitted from illustration) in order to maintain the interval between the developing roller 21 of the developing device 17 or 19 and the surface of the belt-like photosensitive member 1.

Although the structure shown in FIG. 2 is so arranged in order to rotate the developing-device supporting members 25 and 26 that the supporting-member rotation members 28 and 29, which are respectively rotatively supported by the rotational shafts 23 and 24, are used, the present invention is not limited to the aforesaid means for rotating the developing-device supporting members 25 and 26 and therefore another means may be employed. For example, an arrangement may be employed which has guides in the passages through which the developing-device supporting members 25 and 26 are moved. Specifically, an arrangement may be employed in which groove-like or projecting circular arc guides, the centers of which are the positions of the rotational shafts 23 and 24, are formed and rollers to be engaged to the groove-like or projecting circular arc guides are formed in the lower portions of the supporting-member rotation members 28 and 29. As an alternative to this, an arrangement may be employed in which inclined rollers having contact surfaces which align to the passages through which the developing-devices supporting members 25 and 26 are rotated are formed in the lower portions of the supporting-member rotation members 28 and 29.

Although the description has been hereinbefore made about the first color changing unit 15, the second color changing unit 16 is structured and operated in the same manner as the first color changing unit 15. Therefore, the description about the second color changing unit 16 is omitted here.

As described above, according to this embodiment, each of the developing devices 17, 18, 19 and 20 is rotated together with its developing-device supporting member 25 or 26 while making a widthwise directional end of the photosensitive member 1 to be the supporting point and while maintaining the position relative to the direction in which the photosensitive member 1 is moved at the time of the selecting use or no use. Therefore, the space required to locate the developing unit 7 around the photosensitive member 1, more particularly, the space in the lengthwise direction of the photosensitive member 1, can be minimized. Then, the color changing operations of the developing devices to be performed in the first and the second color changing units 15 and 16 will now be described.

Figure 3:
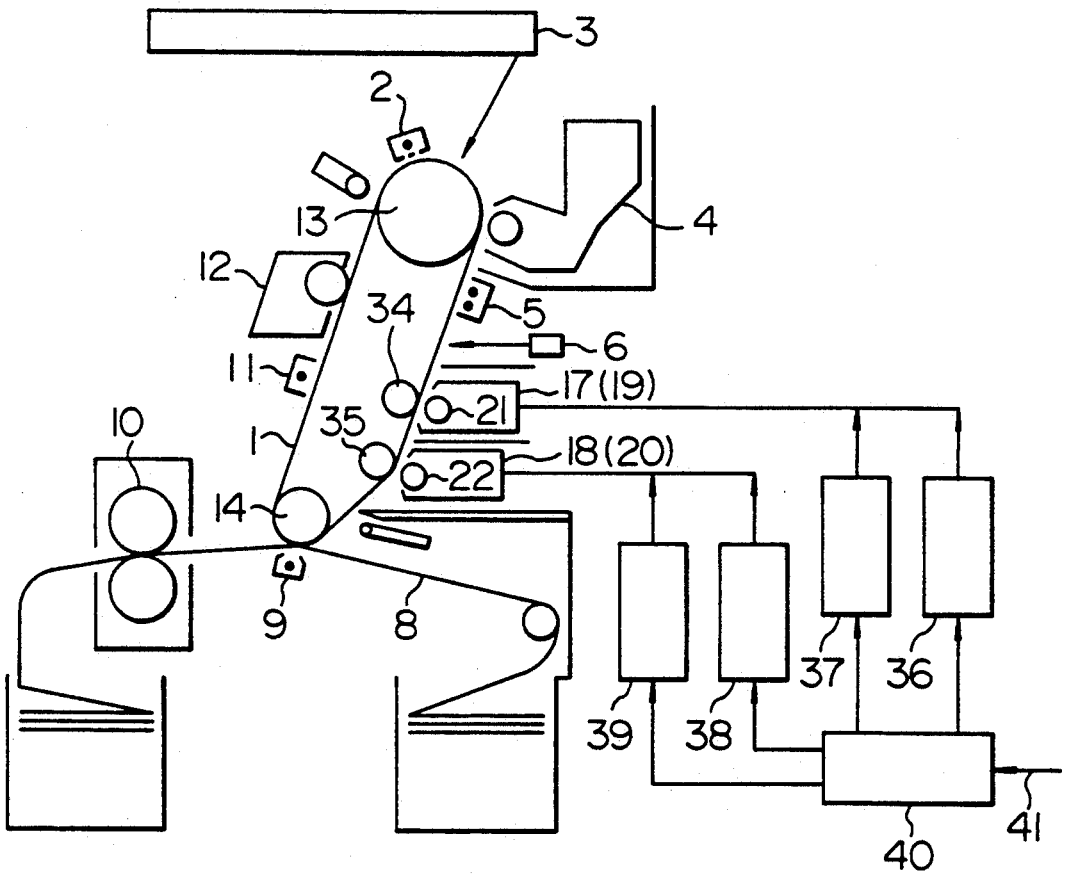
FIG. 3 is a block diagram which illustrates an arrangement to which a color changing circuit drawing for performing the color change of the developing devices included by the color changing unit is added.

FIG. 3 is a block diagram which illustrates a structure so arranged that a color changing circuit is added to the developing devices 17 to 20 of the first and the second color changing units 15 and 16.

Referring to FIG. 3, reference numerals 36 and 38 denote bias voltage adjustment circuits, 37 and 39 denote revolution adjustment circuits for adjusting the developing roll, 40 denotes a control circuit, and 41 denotes a control signal input portion. The other elements which are the same as those shown in FIG. 1 are given the same reference numerals.

The bias voltage adjustment circuit 36 supplies bias voltage to the developing device 17 and 19 included in the first color changing unit 15, while the bias voltage adjustment circuit 38 supplies bias voltage to the developing device 18 and 20 included in the second color changing unit 16. The revolution adjustment circuit 37 for adjusting the revolution of the developing roll controls the revolution of the developing roll 21 corresponding to the developing devices 17 and 19, while the revolution adjustment circuit 39 for adjusting the revolution of the developing roll controls the revolution of the developing roll 22 corresponding to the developing devices 18 and 20. However, the arrangement is so made that the portion of the developing devices 17 to 20, which is not used, is not supplied with the bias voltage and as well as its revolution is not controlled. In this case, the control of the outputs from the bias voltage adjustment circuits 36 and 38 and the adjustment of the outputs from the revolution adjustment circuits 38 and 39 for the developing roll are performed by the control circuit 40.

The operation of the color changing circuit will now be described.

Assuming that the developing devices 17 and 18 are in the state of use, the change of the supply of the bias voltage effected by adjusting the outputs from the bias voltage adjustment circuits 36 and 38 will enable a color between the monocolor toner accommodated in the developing device 17 and that accommodated in the developing device 18 to be created. By considerably reducing the speed of the revolution of the developing roll 21 of the developing device 17 or by stopping the same, the monocolor of the toner accommodated in the developing device 18 can be expressed. Similarly, by considerably reducing the speed of the revolution of the developing roll 22 of the developing device 18 or by stopping the same, the monocolor of the toner accommodated in the developing device 17 can be expressed. Furthermore, by changing the combination of the developing devices 17 to 20 for use, a variety of colors can be expressed.

Figure 4:
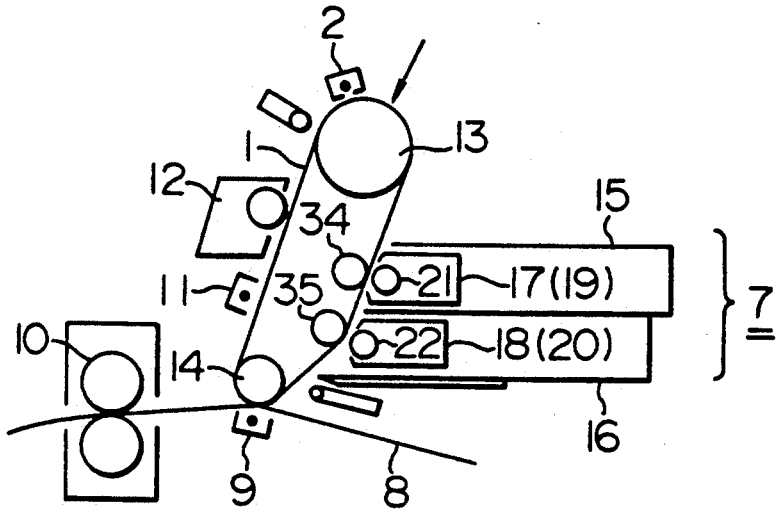
FIG. 4 is a structural view which illustrates a second embodiment of an electrophotographic recording apparatus according to the present invention.

FIG. 4 is a structural view which illustrates a second embodiment of the electrophotographic recording apparatus according to the present invention.

This embodiment has an arrangement so made that the first developing device 4, the second charger 5 and the second exposure means 6 are omitted from the structure according to the first embodiment, and as well as four developing devices 17, 18, 19 and 20 respectively accommodate yellow, magenta, cyan and black toner are disposed in the first and the second color changing units 15 and 16 of the multicolor developing unit 7. The other elements which are the same as those shown in FIG. 1 are given the same reference numerals.

The detailed description about the operation of this embodiment is omitted here since the operation of this embodiment is the same as that of the first embodiment except for an arrangement so made that only any one of the four developing devices 17, 18, 19 or 20 is sequentially brought into the state of use whenever the belt-like photosensitive member 1 is rotated, and, as a result, the four revolutions of the belt-like photosensitive member 1 will enable full color printing to be performed.

According to this embodiment, the overall size of the apparatus can be reduced as compared with the first embodiment by a degree corresponding to the arrangement so made that the first developing device 4, which performs the black color development, is substantially disposed in the first or the second color changing unit 15 or 16.

Figure 5:
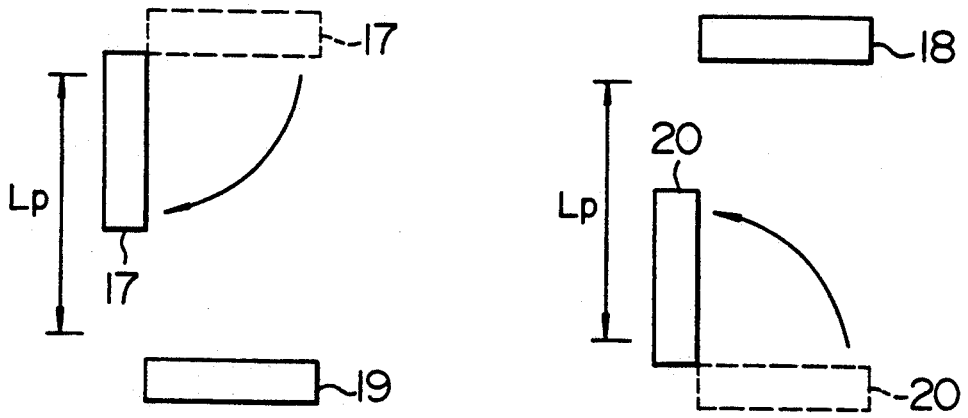
FIG. 5 is a schematic structural view which illustrates the configuration of developing devices of a color changing unit and a state of movement of the developing devices.

FIG. 5 is a schematic structural view which illustrates the configuration and the like of the developing devices in the color changing units 15 and 16 in a case where the width of the belt-like photosensitive member 1 is larger than the width of each of the developing devices 17, 18, 19 and 10.

Referring to FIG. 5, in a case where the width of each of the developing devices 17, 18, 19 and 20 is shorter than the width Lp of the effective printing region of the belt-like photosensitive member 1, either of the developing device 17 and 20 are brought into the state of use at the first rotation of the belt-like photosensitive member 1 so as to perform the development of the width Lp of the belt-like photosensitive member 1 with the first color toner. At the ensuing second rotation of the belt-like photosensitive member 1, the residual developing devices 18 and 19 are brought into the state of use so as to perform the development of the width Lp of the belt-like photosensitive member 1 with the second color toner.

By making the developing devices 17 and 20 to develop the same toner color and by making the developing devices 18 and 19 to develop the same toner color in a case where two toner colors are used, the horizontal directional space required for the multicolor developing unit 7 to perform the color changing operation can be shortened according to this embodiment.

Figure 6:
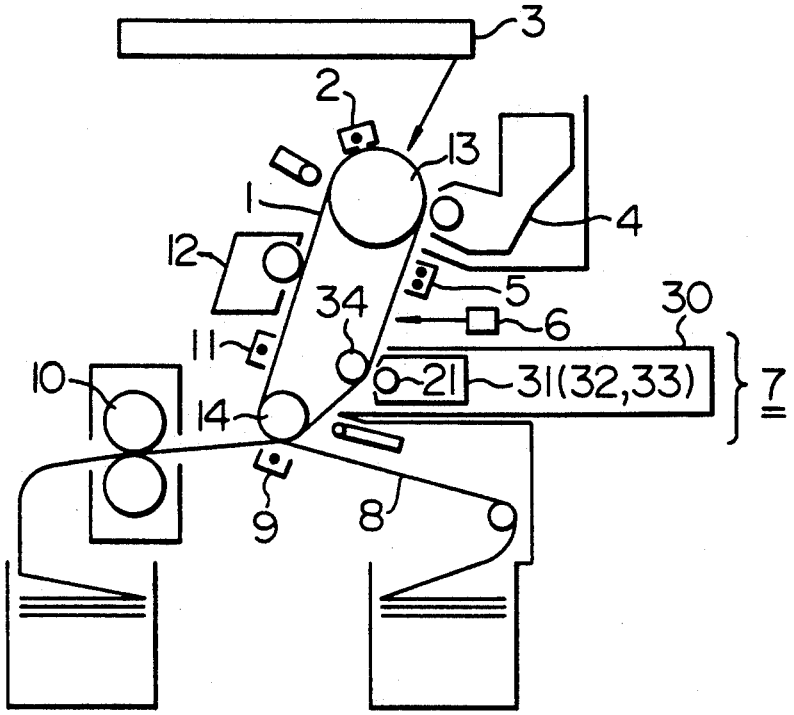
FIG. 6 is a structural view which illustrates a third embodiment of an electrophotographic recording apparatus according to the present invention.

FIG. 6 is a structural view which illustrates a third embodiment of the electrophotographic recording apparatus according to the present invention.

Referring to FIG. 6, reference numeral 30 denotes a color changing unit, and 31, 32 and 33 denote developing devices. The other elements which are the same as those shown in FIG. 1 are given the same reference numerals.

This embodiment is so arranged that the third color changing unit 30 formed into a sole body is employed as the multicolor developing unit 7, and the third color changing unit 30 has three developing devices 31, 32 and 33 so disposed that they can be selectively used.

Figure 7:
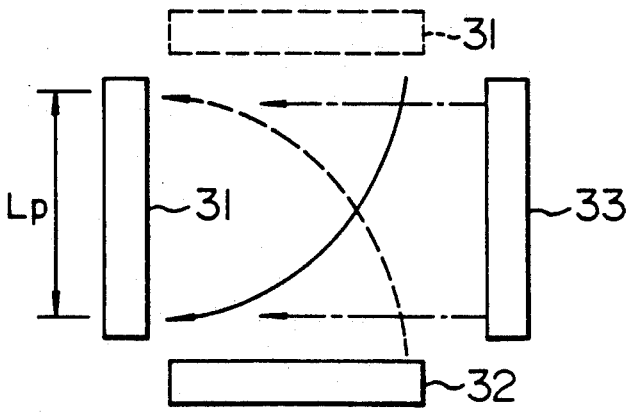
FIG. 7 is a schematic structural view which illustrates the configuration of developing devices of a color changing unit and a state of movement of the developing devices.

FIG. 7 is a schematic structural view which illustrates the configuration and the like of the three developing devices 31, 32 and 33 disposed in the third color changing unit 30.

As shown in FIG. 7, the two developing devices 31 and 32 of the three developing devices 31, 32 and 33 are so arranged that the switch of them between the state of use and the state of no use is performed by the rotation of the developing-device supporting member. Furthermore, the residual developing device 33 is so arranged that it is switched as described above by its parallel movement with respect to the surface of the belt-like photosensitive member 1 in place of the rotation of the developing-device supporting member. The third color changing unit 30 is arranged in such a manner that a desired one (for example, the developing device 31) of the three developing devices 31, 32 and 33 is selectively brought into the state of use and the residual two developing devices 32 and 33 are brought into the state of no use.

According to this embodiment, one color changing unit can be omitted from the structure, so that the overall size of the apparatus can be reduced by a degree corresponding to the omitted color changing unit as compared with the first embodiment.

Although each of the aforesaid embodiments employs the belt-like photosensitive member 1 as the photosensitive member, the present invention is not limited to the structure which uses the belt-like photosensitive member 1 as the photosensitive member. Also the present invention can be applied to an arrangement which employs a photosensitive drum as the photosensitive member.

According to the present invention, each of the developing devices 17, 18, 19 and 20, or 31, 32 and 33 is rotated together with its developing-device supporting member while making a widthwise directional end of the photosensitive member 1 to be the supporting point and while maintaining the position relative to the direction in which the photosensitive member 1 is moved at the time of selecting use or no use. Therefore, the space required to locate the developing unit 7 around the photosensitive member 1, and, more particularly, the space in the direction in which the photosensitive member 1 is moved, can be minimized. Therefore, an effect can be obtained in that the overall size of the electrophotographic apparatus including the developing unit 7 can be reduced.

What is claimed is:

1. An electrophotographic recording apparatus having a plurality of developing devices which are movably supported in the electrophotographic recording apparatus, comprising:

a photosensitive member which moves at a predetermined speed;

an exposure device for exposing said photosensitive member;

a developing unit for developing an electrostatic latent image obtained by said exposure; and a transferring device for transferring a developed visible image to a recording paper sheet or the like, wherein said developing unit includes two developing devices, a plurality of supporting members for supporting said two developing devices and means for rotating said supporting members, and said means for rotating said supporting members providing, for each developing device, a supporting point adjacent to a widthwise directional end of said photosensitive member and moving a developing device in a range from a state where the surface of said photosensitive member and the surface of a developing roller of said developing device run parallel to each other to a state where they are positioned substantially perpendicular to each other.

2. The electrophotographic recording apparatus of claim 1, wherein said plurality of developing devices respectively accommodate different color toner.

3. The electrophotographic recording apparatus of claim 2, wherein said developing unit further includes a third developing device which is fixed at a position at which development of said photosensitive member can always be performed.

4. The electrophotographic recording apparatus of claim 3, wherein said developing unit further includes an additional supporting member, means for moving said additional supporting member in parallel to the surface of said photosensitive member, and a third developing device fastened to said additional supporting member.

5. The electrophotographic recording apparatus of claim 4, wherein each of said plurality of supporting members has a pressing device which is capable of adjusting the position at which a developing device associated with that supporting member is fastened when that developing device is used.

6. The electrophotographic recording apparatus of claim 4, wherein said means for rotating said plurality of supporting members include a rotational shaft disposed adjacent to the widthwise directional end of said photosensitive member as a supporting point.

7. The electrophotographic recording apparatus of claim 4, wherein said means for rotating said plurality of supporting members include a supporting-member movement guide formed into circular arcs, the centers of which are adjacent to widthwise directional ends of said photosensitive member.

8. The electrophotographic recording apparatus of claim 2, wherein said developing unit further includes an additional supporting member, means for moving said additional supporting member in parallel to the surface of said photosensitive member, and a third developing device fastened to said additional supporting member.

9. The electrophotographic recording apparatus of claim 8, wherein each of said plurality of supporting members has a pressing device which is capable of adjusting the position at which a developing device associated with that supporting member is fastened when that developing device is used.

10. The electrophotographic recording apparatus of claim 8, wherein said means for rotating said plurality of supporting members include a rotational shaft disposed adjacent to the widthwise directional end of said photosensitive member as a supporting point.

11. The electrophotographic recording apparatus of claim 8, wherein said means for rotating said plurality of supporting members include a supporting-member movement guide means formed into circular arcs, the centers of which are adjacent to widthwise directional ends of said photosensitive member.

12. The electrophotographic recording apparatus of claim 1, wherein said developing device unit further includes a third developing device which is fixed at a position at which development of said photosensitive member can always be performed.

13. The electrophotographic recording apparatus of claim 12, wherein said developing unit further includes an additional supporting member, means for moving said additional supporting member in parallel to the surface of said photosensitive member, and a third developing device fastened to said additional supporting member.

14. The electrophotographic recording apparatus of claim 13, wherein each of said plurality of supporting members has a pressing device which is capable of adjusting the position at which a developing device associated with that supporting member is fastened when that developing device is used.

15. The electrophotographic recording apparatus of claim 13, wherein said means for rotating said plurality of supporting members include a rotational shaft disposed adjacent to the widthwise directional end of said photosensitive member as a supporting point.

16. The electrophotographic recording apparatus of claim 13, wherein said means for rotating said plurality of supporting members include a supporting-member movement guide formed into circular arcs, the centers of which are adjacent to widthwise directional ends of said photosensitive member.

17. The electrophotographic recording apparatus of claim 1, wherein said developing unit further includes an additional supporting member, means for moving said additional supporting member in parallel to the surface of said photosensitive member, and a third developing device fastened to said additional supporting member.

18. The electrophotographic recording apparatus of claim 17, wherein each of said plurality of supporting members has a pressing device which is capable of adjusting the position at which a developing device associated with that supporting member is fastened when that developing device is used.

19. The electrophotographic recording apparatus of claim 17, wherein said means for rotating said plurality of supporting members include a rotational shaft disposed adjacent to the widthwise directional end of said photosensitive member as a supporting point.

20. The electrophotographic recording apparatus of claim 17, wherein said means for rotating said plurality of supporting members include a supporting-member movement guide formed into circular arcs, the centers of which are adjacent to widthwise directional ends of said photosensitive member.

21. The electrophotographic recording apparatus of claim 1, wherein each of said plurality of supporting members of said developing unit is shorter than the widthwise directional length of said photosensitive member.

22. The electrophotographic recording apparatus of claim 21, wherein each of said plurality of supporting members has a pressing device which is capable of adjusting the position at which a developing device associated with that supporting member is fastened when that developing device is used.

23. The electrophotographic recording apparatus of claim 21, wherein said means for rotating said plurality of supporting members include a rotational shaft disposed adjacent to the widthwise directional end of said photosensitive member as a supporting point.

24. The electrophotographic recording apparatus of claim 21, wherein said means for rotating said plurality of supporting members include a supporting-member movement guide formed into circular arcs, the centers of which are adjacent to widthwise directional ends of said photosensitive member.

25. The electrophotographic recording apparatus of claim 1, wherein each of said plurality of supporting members has a pressing device which is capable of adjusting the position at which a developing device associated with that supporting member is fastened when that developing device is used.

26. The electrophotographic recording apparatus of claim 1, wherein said means for rotating said plurality of supporting members include a rotational shaft disposed adjacent to the widthwise directional end of said photosensitive member as a supporting point.

27. The electrophotographic recording apparatus of claim 1, wherein said means for rotating said plurality of supporting members include a supporting-member movement guide formed into circular arcs, the centers of which are adjacent to widthwise directional ends of said photosensitive member.

* * * * *

UNITED STATES PATENT AND TRADEMARK OFFICE

CERTIFICATE OF CORRECTION

PATENT NO. : 5,307,147

DATED : April 26, 1994

INVENTOR(S) : Takao KUMASAKA et al.

It is certified that error appears in the above-indentified patent and that said Letters Patent is hereby corrected as shown below:

On the title page, in the Abstract, line 4, after "it", change "i" to --is--.

| Column | Line | Corrections |
|---|---|---|
| 2 | 24 | After "unit" insert --.--. |
| 2 | 25 | Before "by" insert --The present invention accomplishes this--. |
| 3 | 54 | After "devices" change ";" to --.--. |
| 6 | 18 | Change "rotative" to --rotatively--. |
| 8 | 54 | After "and" change "10" to --20--. |

Signed and Sealed this

Thirteenth Day of September, 1994

*Attest:*

*Attesting Officer*

Bruce Lehman

BRUCE LEHMAN

*Commissioner of Patents and Trademarks*